United States Patent [19]

Hartke et al.

[11] Patent Number: 5,024,188

[45] Date of Patent: Jun. 18, 1991

[54] FUEL SUPPLY SYSTEM COMPONENT ASSEMBLY

[75] Inventors: David J. Hartke; Kathleen A. Appelt, both of Gurnee, Ill.

[73] Assignee: Outboard Marine Corporation, Waukegan, Ill.

[21] Appl. No.: 487,669

[22] Filed: Mar. 2, 1990

[51] Int. Cl.[5] ..... F02F 7/00

[52] U.S. Cl. ..... 123/195 A; 123/73 A; 123/198 C; 123/509; 123/DIG. 5

[58] Field of Search ..... 123/73 A, 73 AD, 509, 123/195 A, 198 E, 198 R, 198 C, 65 B, DIG. 5

[56] References Cited

U.S. PATENT DOCUMENTS

| | | | |
|---|---|---|---|
| 2,771,868 | 11/1956 | Knuth | 123/73 A |
| 4,142,502 | 3/1979 | Nakano et al. | 123/195 A |
| 4,266,514 | 5/1981 | Tyner | 123/73 A |
| 4,286,553 | 9/1981 | Baltz et al. | 123/73 A |
| 4,312,314 | 6/1982 | McChesney et al. | 123/438 |
| 4,473,340 | 9/1984 | Walsworth | 417/274 |
| 4,474,144 | 10/1984 | Tanaka et al. | 123/195 A |
| 4,519,347 | 5/1985 | Nolff | 123/195 A |
| 4,697,782 | 10/1987 | Ban | 248/639 |
| 4,702,202 | 10/1987 | Hensel et al. | 123/73 A |
| 4,793,300 | 12/1988 | Kadoshima et al. | 123/195 A |
| 4,870,392 | 9/1989 | Baltz et al. | 340/608 |

*Primary Examiner*—Noah P. Kamen

*Attorney, Agent, or Firm*—Michael, Best & Friedrich

[57] ABSTRACT

Disclosed herein is an engine comprising an engine block, a crankcase cover mounted on the engine block and including opposite first and second sides, a first carburetor mounted on the block at the first side of the crankcase cover, a second carburetor mounted on the block at the second side of the crankcase cover, a bracket supported by the crankcase cover intermediate the first and second carburetors, and a fuel supply component mounted on the bracket and comprising one of a fuel pump, an oil pump, a combined fuel and oil pump, a fuel vapor separator, a fuel vapor pump, a fuel filter, a primer fuel control valve, and a vacuum switch.

8 Claims, 3 Drawing Sheets

FUEL SUPPLY SYSTEM COMPONENT ASSEMBLY

RELATED APPLICATION

Attention is directed to U.S. application Ser. No 316,153, filed Feb. 27, 1989 and entitled "Internal Combustion Engine", which application is incorporated herein by reference.

BACKGROUND OF THE INVENTION

1. Field of the Invention

The invention relates generally to internal combustion engines and more particularly to two stroke internal combustion engines including crankcase covers.

Still more particularly, the invention relates to fuel feeding or supply systems for two stroke internal combustion engines and to mounting arrangements for components of such fuel feeding or supply systems including fuel pumps, oil pumps, fuel filters, primer fuel controls, vapor separators and pumps, and vacuum switches.

2. Reference to Prior Art

In the past, it has been common in two stroke internal combustion engines to mount on the crankcase cover one or more intake manifolds and carburetors, together with reed valves in the air intake passages which lead to the crankcases and which were defined, in the past, by the crankcase cover, the intake manifold and the carburetor.

Other components of the fuel supply system were supported elsewhere by the engine block or otherwise.

SUMMARY OF THE INVENTION

The invention provides an engine comprising a crankcase cover, a bracket, a fuel supply component mounted on the bracket and comprising one of a fuel pump, an oil pump, a combined fuel and oil pump, a fuel vapor separator, a fuel vapor pump, a fuel filter, a primer fuel control valve, and a vacuum switch, and means mounting the bracket on the cover.

In one embodiment in accordance with the invention, the means mounting the bracket on the cover includes means for vibrationally isolating the bracket and the cover from each other.

The invention also provides an engine comprising an engine block, a crankcase cover mounted on the engine block and including opposite first and second sides, a first carburetor mounted on the block at the first side of the crankcase cover, a second carburetor mounted on the block at the second side of the crankcase cover, a bracket supported by the crankcase cover intermediate the first and second carburetors, and a fuel supply component mounted on the bracket and comprising one of a fuel pump, an oil pump, a combined fuel and oil pump, a fuel vapor separator, a fuel vapor pump, a fuel filter, a primer fuel control valve, and a vacuum switch.

The invention also provides an engine comprising a crankcase cover, a bracket having therein a fuel conduit including a socket, means mounting the bracket on the crankcase cover, a fuel supply component comprising one of a fuel pump, a combined fuel and oil pump, a primer fuel control valve, and a vacuum switch, which fuel supply component includes a conduit having an end, and means mounting the fuel supply component on the bracket with the conduit end sealingly received in the socket.

The invention also provides a fuel supply system component assembly comprising a bracket adapted to be mounted on an engine member and having therein a fuel supply conduit including a socket, and a fuel supply component comprising one of a fuel pump, a combined fuel and oil pump, a primer fuel control valve, and a vacuum switch, which fuel component includes a conduit having an end, and means mounting the fuel supply component on the bracket with the conduit end sealingly received in the socket.

The invention also provides a fuel supply system component assembly comprising a mounting bracket including an interior fuel supply conduit comprising first and second sockets, and a fuel reservoir adapted to be connected to a source of fuel and having an open portion, an interior fuel/oil mixture conduit adapted to be connected to a point of use and including an inlet socket, and a primer fuel socket in one of the fuel supply conduit and the fuel/oil mixture conduit, a combined fuel and oil pump including a fuel/oil mixture discharge outlet, a fuel inlet, an oil inlet adapted to be connected to a source of oil, and a pressure inlet adapted to be connected to a source of pulsating pressure, means mounting said combined fuel and oil pump on the bracket with the fuel inlet sealingly received in the first socket in the fuel supply conduit, and with the fuel/oil mixture discharge outlet sealingly received in the inlet socket of the fuel/oil mixture conduit, a primer fuel control valve including a primer fuel conduit having a primer fuel inlet, and a primer fuel outlet adapted to be connected to exterior conduit, means mounting the primer fuel control valve on the bracket with the primer fuel inlet sealingly received in the primer fuel socket, a fuel vapor pump assembly including a reservoir cover member and a fuel vapor pump including a fuel vapor inlet, a fuel vapor outlet adapted to be connected with an exterior conduit, and a pressure inlet adapted to be connected to a source of pulsating Pressure, means mounting the fuel vapor pump assembly on said bracket with the cover member closing the open portion of the reservoir, and with the fuel vapor inlet in communication with the reservoir, a vacuum switch including a pressure fluid inlet, and means mounting the vacuum switch on the bracket with the pressure fluid inlet sealingly received in the second socket in the fuel supply conduit.

The invention also provided a fuel supply system component assembly comprising a mounting bracket including an interior fuel supply conduit including a fuel reservoir portion having an open portion, an outlet socket, and a fuel inlet nipple adapted to be connected to a source of fuel, an interior fuel/oil mixture conduit adapted to be connected to a point of use and including an inlet socket, and a primer fuel socket in one of the fuel supply conduit and the fuel/oil mixture conduit, a combined fuel and oil pump assembly including a fuel-/oil mixture discharge outlet, a fuel inlet, an oil inlet adapted to be connected to a source of oil, and a pressure inlet adapted to be connected to a source of pulsating pressure, means mounting the combined pump assembly on the bracket with the fuel inlet sealingly received in the outlet socket, and with the fuel/oil mixture discharge outlet sealingly received in the inlet socket of the fuel/oil mixture conduit, a primer fuel control valve including a primer fuel conduit having a primer fuel inlet, and a primer fuel outlet adapted to be connected to an exterior conduit, means mounting the primer fuel control valve on the bracket with the primer fuel inlet sealingly received in the primer fuel socket, a fuel vapor pump assembly including a reservoir cover member and a fuel vapor pump including a fuel vapor inlet, a fuel vapor outlet adapted to communicate with an exterior conduit, and a pressure inlet adapted to be connected to a source of pulsating pressure, means mounting the fuel vapor pump assembly on the bracket with the cover member closing the open portion of the reservoir, and with the fuel vapor inlet communicating with the reservoir, a vacuum switch including a pressure fluid inlet communicating with the fuel supply conduit, and means mounting the vacuum switch on the bracket.

The invention also provides a fuel supply system component assembly comprising a mounting bracket including an interior fuel supply conduit, an interior fuel/oil mixture conduit including an inlet socket, a discharge port, and a primer fuel socket, and a fuel reservoir communicating with said fuel conduit and having a first open portion and a second open portion, a fuel filter removably located in the first open portion, a cover removably connected to the first open portion and including a fuel inlet nipple adapted to be connected to a source of fuel, a combined fuel and oil pump including a fuel/oil mixture discharge outlet, a fuel inlet, an oil inlet adapted to be connected to a source of oil, and a pressure inlet adapted to be connected to a source of pulsating pressure, means removably mounting the combined fuel and oil pump on the bracket with the fuel/oil mixture discharge outlet received in the inlet socket of the fuel/oil mixture conduit, an exterior conduit connecting the fuel supply conduit and the fuel inlet of the combined fuel and oil pump, a primer fuel control valve including a fuel/oil mixture inlet, first and second fuel/oil mixture outlets adapted to be connected to respective exterior conduits, a primer fuel/oil mixture conduit extending between said fuel/oil mixture inlet and said fuel/oil mixture outlets and including therein a solenoid operated valve member movable between a closed position preventing flow of primer fuel/oil mixture and an open position permitting flow of primer fuel/oil mixture, means removably mounting the primer fuel control valve on the bracket with the fuel/oil mixture inlet sealingly received in the primer fuel socket, a reservoir cover member including a fluid pressure sensing outlet, a fuel vapor passage, and a fuel/oil mixture conduit including an inlet port and first and second discharge outlets adapted to be connected to respective exterior conduits, means removably mounting the cover member on the bracket with the cover member closing the second open portion of the reservoir, with the fuel vapor passage communicating with the reservoir, with the fluid pressure sensing outlet communicating with the reservoir, and with the fuel/oil mixture inlet port in communication with the fuel/oil mixture discharge port, a fuel vapor pump including a fuel vapor inlet, a fuel vapor outlet adapted to communicate with an exterior conduit, and a pressure inlet adapted to be connected to a source of pulsating pressure, means removably mounting the fuel vapor pump on the cover member with the fuel vapor passage in communication with the fuel vapor inlet, a vacuum switch including fluid pressure inlet, an exterior conduit connecting the fluid pressure inlet and the fluid pressure sensing outlet, and means removably mounting the vacuum switch on the bracket.

Other objects and advantages of the invention will become known by reference to the following general description, claims and appended drawings.

THE DRAWINGS

Figure 1:
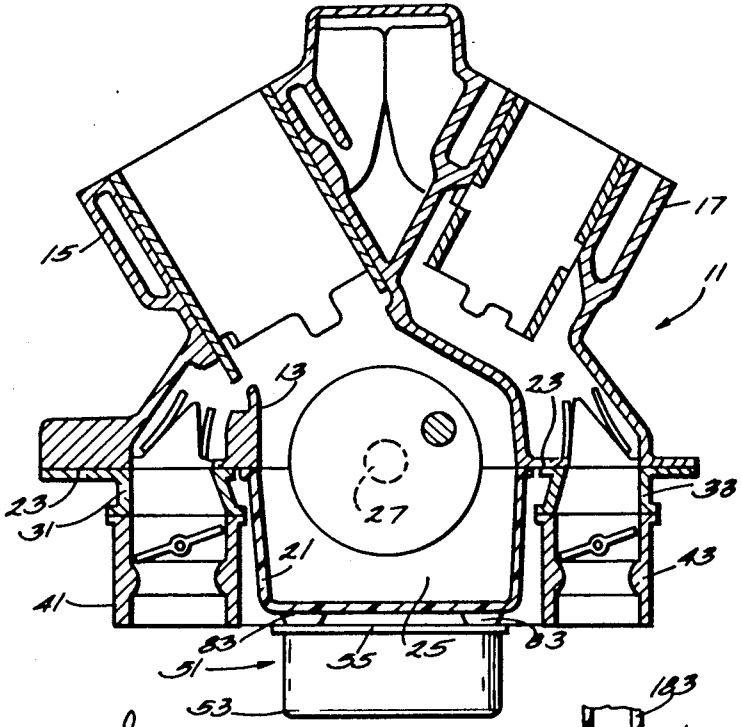
FIG. 1 is a sectional view of an internal combustion engine embodying various of the features of the invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

Shown in FIG. 1 of the drawings is a two stroke internal combustion engine 11 of the V-type. More particularly, the engine 11 shown in FIG. 1 includes an engine block 13 defining two banks 15 and 17 of cylinders and can represent either a two cylinder engine, a four cylinder engine, a six cylinder engine, or otherwise. The engine also includes a crankcase cover 21 which is suitably attached to a mounting surface 23 on the engine block 13 and which can be constructed of metal or plastic. Located within the crankcase cover 21 are individual crankcases 25 (one shown), one for each cylinder, and a crankshaft 27. Also mounted on the mounting surface 23 are first and second intake manifolds 31 and 33, respectively. First and second carburetors 41 and 43 are respectively mounted on the first and second intake manifolds 31 and 33. Preferably one carburetor is provided for each cylinder. The first intake manifold 31 and the first carburetor 41 are located to one side of the crankcase cover 21 and the second intake manifold 33 and the second carburetor 43 are located to the other side of the crankcase cover 21. Any suitable intake manifold and carburetor construction can be employed.

The engine 11 also includes a fuel supply system 51 including a fuel supply system component assembly 53 (shown schematically in FIG. 1) which is adapted to supply fuel to the carburetors 41 and 43 and which includes a mounting bracket 55 which supports one or more of the following fuel system components, (See FIGS. 2, 3 and 4.) i.e., a fuel filter 61, a fuel separator 63, a fuel vapor pump 65, a fuel pump 67, an oil pump 69 (which fuel and oil pumps can be combined into a combined fuel and oil mixture pump 71) a primer fuel control valve 73, and a vacuum switch 75. In the illustrated construction, all of the above components are found in the fuel supply system component assembly 53.

Means are provided for supporting the mounting bracket 55 on the crankcase cover 21 and centrally between the carburetors 41 and 43. While various suitable constructions can be employed, in the disclosed construction, the mounting bracket 55 has (see FIG. 4) four mounting holes 81 and (see FIG. 1) four correspondingly located mounting bosses 83 are provided on the crankcase cover 21, whereby the mounting bracket 55 is located in somewhat spaced relation to the crankcase cover 21. Any suitable fasteners can be employed. In the disclosed construction, such fasteners comprise four bolts 85 which extend through the mounting holes 81 and into the bosses 83.

The means for supporting or mounting the mounting bracket 55 from the crankcase cover 21 also includes means for vibrationally isolating the crankcase cover 21 and the mounting bracket 55 from each other. While other suitable constructions can be employed, in the disclosed construction, such means comprises, for each mounting hole 81 (see FIG. 2), a grommet 87 which is fabricated of rubber or rubber-like material and which includes washer portions 89 extending on both the front and rear surfaces of the mounting bracket 55, and a sleeve portion 91 which connects the front and rear washer portions 89 and extends in the associated mounting hole 81, all with the result that each associated mounting bolt 85 is isolated or separated from the mounting bracket 55 by the rubber or rubber-like material of the associated grommet 87.

Figure 6:
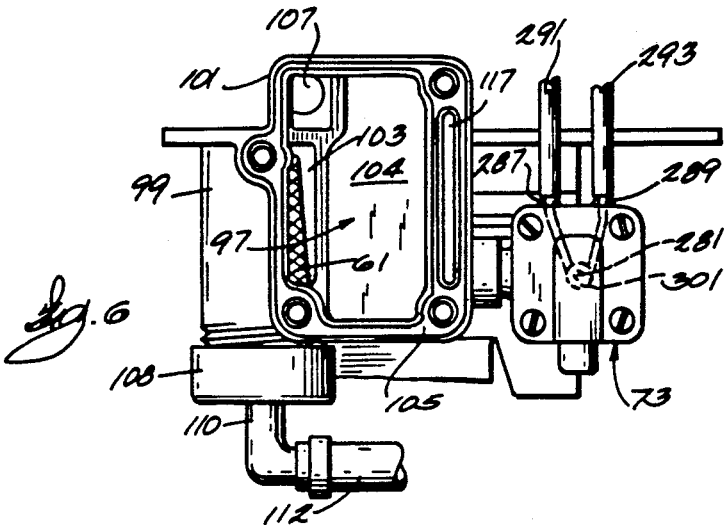
FIG. 6 is a sectional view taken along line 6—6 of FIG. 3.

While other constructions can be employed, the mounting bracket 55 is formed of rigid plastic and includes at least two conduits and portions of the fuel vapor separator 63. More particuarly, the mounting bracket 55 includes a generally flat base portion 93 which includes the four mounting holes 81 and (see FIGS. 3 and 6) a reservoir 97 which is part of the fuel separator 63, and which is located at the top of the mounting bracket 55 and includes a first cylindrical portion 99 which is open at the front end, and a second box-like portion 101 which communicates with the cylindrical portion 99 through an opening 103 and which has an open top 104 located in a flat mounting surface 105.

The mounting bracket 55 also integrally includes (see FIG. 3) an interior fuel supply conduit or passage or bore 107 which communicates with the reservoir 97 and extends therefrom to the bottom of the mounting bracket 55 and terminates in a discharge end or fitting 109. Any suitable arrangement can be employed interiorly of the mounting bracket 55 to provide the fuel supply conduit or passage 107.

The open end of the cylindrical portion 99 is closed by a removable cover or caP 108 which includes an inlet 110 terminating in the form of a nipple connected to an exterior fuel supply hose 112 adapted to communicated with a suitable source of fuel. Located within the cylindrical portion 99 of the reservoir 97 is the filter 61.

The mounting bracket 55 also integrally includes (see FIGS. 2 and 4) an interior fuel/oil mixture passage or conduit 111 which includes an inlet socket or well 113, a primer fuel socket or well 115 for discharging primer fuel/oil mixture to the primer fuel control valve 73, and a discharge port 117 in the surface 105 adjacent the open end of the reservoir 97. Any suitable arrangement can be employed interiorly of the mounting bracket 55 to provide the fuel/oil mixture passage or conduit 111.

The fuel supply system component assembly 53 also includes the before mentioned fuel vapor pump 65 which is removably mounted on a reservoir cover member or part 121, which is fabricated of plastic, which includes a flat surface 123 mating with the flat mounting surface 105 of the mounting bracket 55, and which, when removably connected or assembled on the bracket 55 by any suitable fasteners, as for instance screws, closes the open top 104 of the box-like reservoir portion 101 to complete the fuel reservoir 97. Also included in the cover member or part 121 is a fuel/oil mixture conduit or passage 125 including an inlet port 129 which is located in the surface 123 and which communicates with the discharge port 117 in the bracket 55. The fuel/oil mixture passage 125 terminates at oppositely extending discharge outlets 133 which are in the form of first and second nipples and which are respectively adapted to be connected to suitable first and second hoses or tubes 135 and 137 which, in turn, are respectively adapted to the communicate with the first and second carburetors 41 and 43. If desired, only one discharge outlet could be employed.

The cover member or part 121 also includes (see FIG. 4) a fluid pressure sensing bore or conduit 141 which, when the cover member or part 121 is assembled on the mounting bracket 55, communicates, at the one end, (see FIG. 3) through a port 143 with the reservoir 97 and which, at the other end, terminates in an outlet 145 in the form of a nipple.

The cover member or part 121 also includes (see FIG. 5) a fuel vapor passage 151 which, at one end, communicates with the reservoir 97 and which, at the other end, terminates in a port 153 in a fuel vapor pump mounting surface 155.

Supported by the cover member or part 121 is a float 161 which moves a valve member 163 relative to a valve seat in the fuel vapor passage 151 to control fuel vapor flow from the fuel separator 63. In this last regard, when the fuel in the reservoir 97 drops below a predetermined level, operation of the float 161 permits the valve member 163 to move to an open position, thereby opening the fuel vapor passage 151.

The cover member or part 121 also removably supports the fuel vapor pump 65 which, as indicated, is mounted on the mounting surface 155 of the cover part 121 by any suitable means, such as screws.

Figure 5:
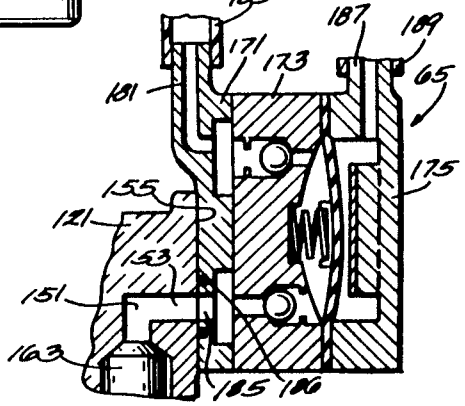
FIG. 5 is a sectional view taken along line 5—5 of FIG. 3.

More particularly, as shown in FIG. 5, the fuel vapor pump 65 is provided consequent to assembly of three disc like members 171,173,175 which, in turn, as indicated, are assembled to the cover part 121 by suitable fasteners, and are also assembled together by suitable fasteners, such as screws. The fuel vapor pump 65 is believed to be conventionally constructed and includes a pressure inlet 187 in the form of a nipple which is connected to any suitable exterior hose or conduit 189 which, in turn, is adapted to be connected to a suitable source of pulsating pressure. In the disclosed construction, it is contemplated that the exterior hose 189 will be connected to one of the engine crankcases 25.

The fuel vapor pump 65 also includes a fuel vapor inlet port 185 which mates with the fuel vapor passage port 153 in the mounting surface 155 of the cover member or part 121. An "O" ring 186 is employed to seal the connection of the inlet port 185 with the fuel vapor passage port 121. In addition, the fuel vapor pump 65 includes a fuel vapor outlet 181 in the form of a nipple receiving an exterior conduit in the form of a hose or tube 183 adapted for conveying fuel vapor to a suitable point in the engine, as for instance to an air silencer (not shown).

The fuel supply system component assembly 53 also includes the before mentioned combined fuel and oil pump 71 which is actuated by pulsing pressure and which includes (see FIGS. 2 and 3) the before mentioned fuel pump 67 and oil pump 69. While other fuel and oil pumping arrangements can be employed, the disclosed fuel and oil pump 71 is constructed in general accordance with U.S. Pat. No. 4,473,340, issued Sept. 25, 1984, which patent is incorporated herein by reference.

Still more particularly, the combined fuel and oil pump 71 includes an oil inlet 251 in the form of a nipple receiving an exterior hose or conduit 253 adapted to be connected to a suitable source of oil, a fuel inlet 255 in the form of a nipple 257, a fuel/oil mixture outlet 259, and (see FIG. 2) a pressure inlet 261 in the form of a nipple receiving an exterior hose or conduit 263 adapted to be connected to a source of pulsating pressure. While various pressure sources can be employed, the disclosed construction contemplates connection of the exterior hose 263 to one of the engine crankcases 25.

Means are provided for removably mounting the combined fuel and oil pump 71 on the mounting bracket 55. While other arrangements can be employed, in the disclosed construction, the combined fuel and oil pump 71 is fixed to the mounting bracket 55 by a plurality of screws 275 and in position such that (see FIG. 2) the fuel/oil mixture outlet 259 is sealingly received in the fuel/oil mixture inlet socket or well 113 in the mounting bracket 55. Any suitable means can be provided to seal this connection. In the disclosed construction a pair of 0-rings 277 are employed.

The fuel supply system component assembly 53 also includes the before mentioned primer fuel control valve 73 which controls flow of primer fuel/oil mixture, which includes (see FIG. 4) a primer fuel/oil mixture conduit 281 terminating, at one end, in a fuel/oil mixture inlet 283 sealingly received in the primer fuel socket 115 which is part of the fuel/oil mixture passage or conduit 111 in the mounting bracket 55. Any suitable means can be provided to seal this connection. In the disclosed construction, a pair of 0-rings 285 are employed.

The primer fuel/oil mixture conduit 281 also includes an outlet which (see FIG. 6) is in the form of two oppositely extending nipples 287 and 289 which are respectively connected (see FIGS. 2 and 6) to an exterior hoses or lines 291 and 293. One line 291 is connected to one or more primer ports (not shown) in the inlet manifold 31 associated with one of the engine cylinder banks 15 and 17 and the other line 293 is connected to one or more primer ports (not shown) in the inlet manifold 33 associated with the other of the cylinder banks 15 and 17.

Also included in the primer fuel control valve 73 is (see FIG. 2) a conventional valve member 301 which is operable between a closed position preventing flow in the primer fuel/oil mixture conduit 281 and an open position permitting flow therein. The valve member 301 is actuated for movement between its positions by a spring (not shown) and (see FIG. 2) by a solenoid 303 which is connected (see FIG. 4) by a pair of leads 305 to any suitable operator. In the disclosed construction, it is contemplated that the solenoid 303 is actuated to permit primer fuel/oil mixture flow through the conduit 281 by actuation of a primer of ignition switch (not shown).

One example of a suitable solenoid actuated primer fuel control valve is disclosed in U.S. Pat. No. 4,286,553, issued Sept. 1, 1981.

Means are provided for releasably securing the primer fuel control valve 73 to the mounting bracket 55 with the primer fuel/oil mixture inlet 283 sealingly received in the primer fuel socket 115 of the fuel/oil mixture conduit or passage 111 in the mounting bracket 55. While other constructions can be employed, in the disclosed construction, such means comprises a pair of screws 307.

The fuel supply system component assembly 53 also includes (see FIGS. 3 and 4) the before mentioned vacuum switch 75 which includes a suitable pressure fluid inlet 353 and which is adapted to be connected, as for instance, by a pair of electrical leads 351, to a warning circuit including a warning device (not shown) such as a horn for the purpose of sounding an alarm when the pressure in the fuel supply system falls below a predetermined pressure. One suitable circuit is disclosed in U.S. Pat. No. 4,870,392 issued Sept. 26, 1989. Any suitable vacuum switch construction can be employed.

Means are provided for removably securing the vacuum switch 75 to the mounting bracket 55. While other constructions can be employed, in the disclosed construction, the vacuum switch 75 includes (see FIG. 3) a boss or projection 355 which extends through an opening 357 in the mounting bracket 55 and which receives a press-fit nut or collar 359 which securely retains the vacuum switch 75 in assembled relation on the mounting bracket 55.

The fuel supply system component assembly 53 also includes (see FIG. 3) means in the form of a tube or hose 371 connected between the pressure fluid inlet 353 of the vacuum switch 75 and the pressure fluid outlet 145 in the cover member 121, whereby the vacuum switch 75 senses the pressure in the fuel supply system, and in particular, in the reservoir 97.

The fuel supply system component assembly 53 also includes a fuel supply tube or hose 375 which, at one end, is connected to the fuel supply inlet 255 of the combined fuel and oil pump 71 and which, at the other end, is connected to the discharge end 109 of the fuel supply conduit 107 in the mounting bracket 55.

Figure 2:
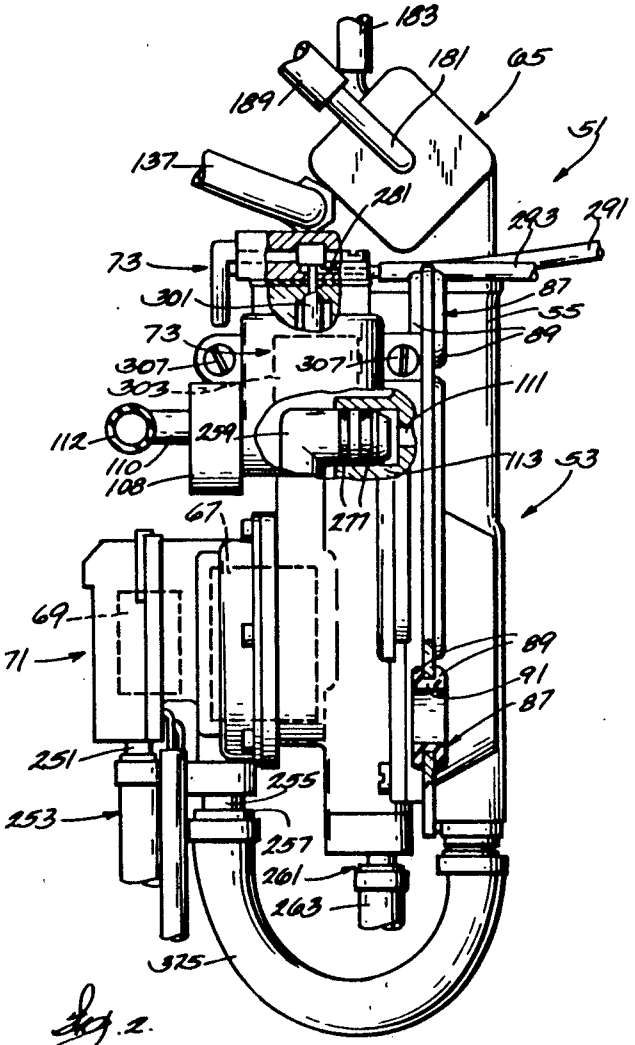
FIG. 2 is an enlarged view, partially in section, of one side of a portion of the internal combustion engine shown in FIG. 1.
Figure 4:
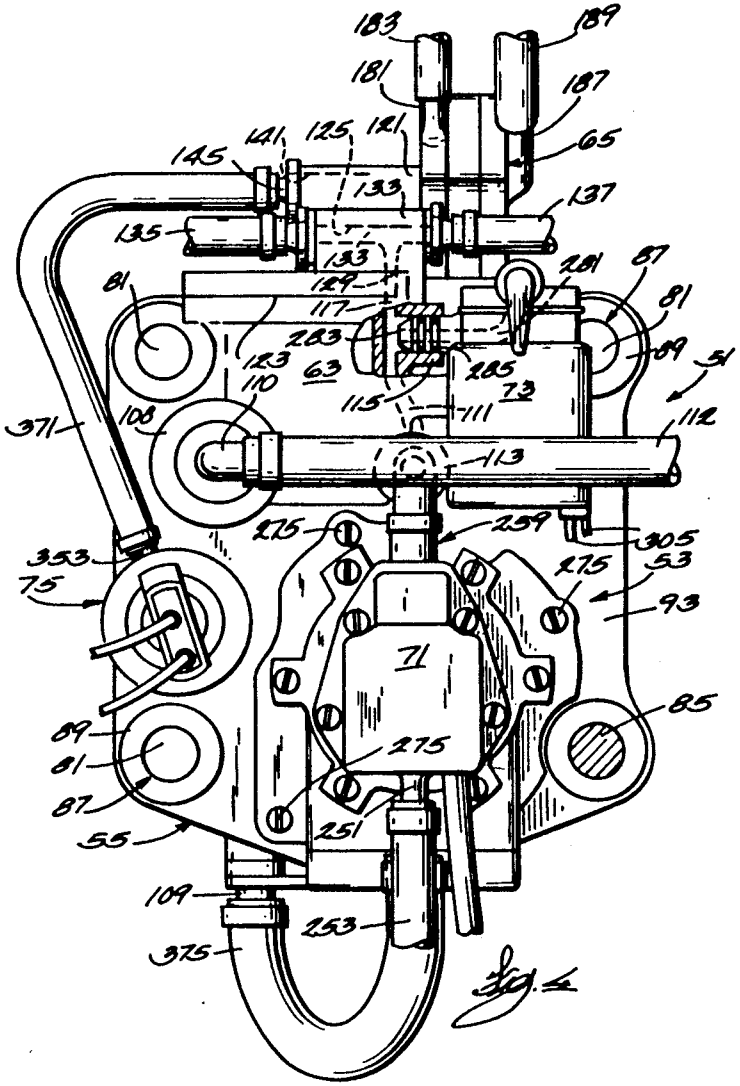
FIG. 4 is an enlarged view, partially in section, of the front of the portion of the internal combustion engine shown in FIG. 2
Figure 3:
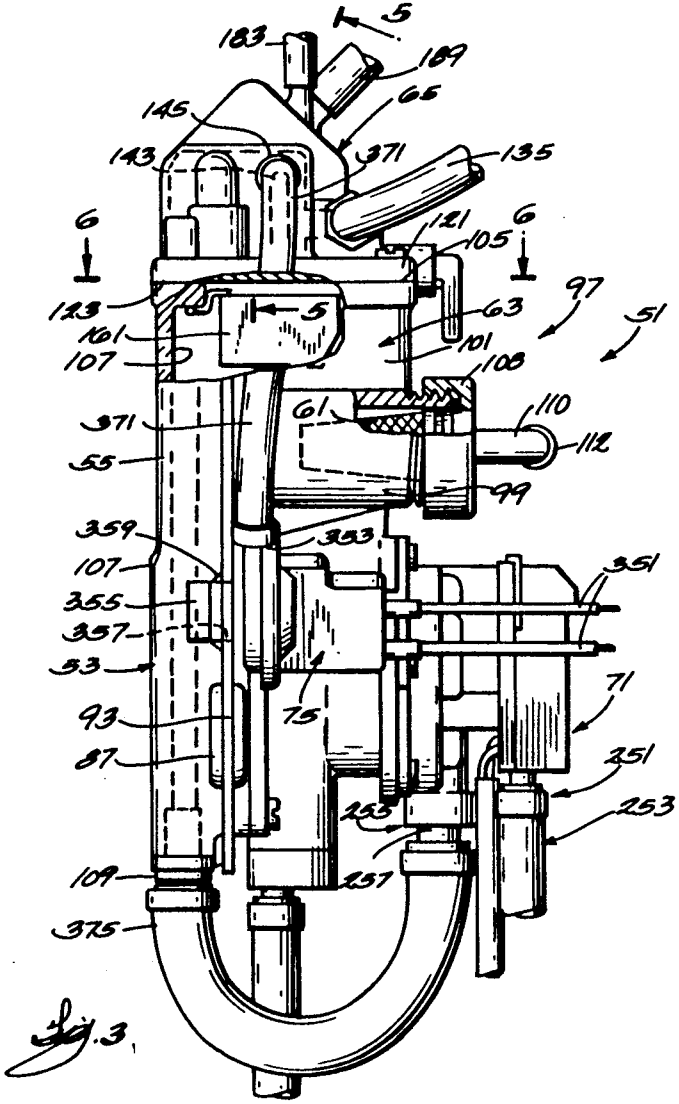
FIG. 3 is an enlarged view, partially in section, of the other side of the portion of the internal combustion engine shown in FIG. 2.
Figure 7:
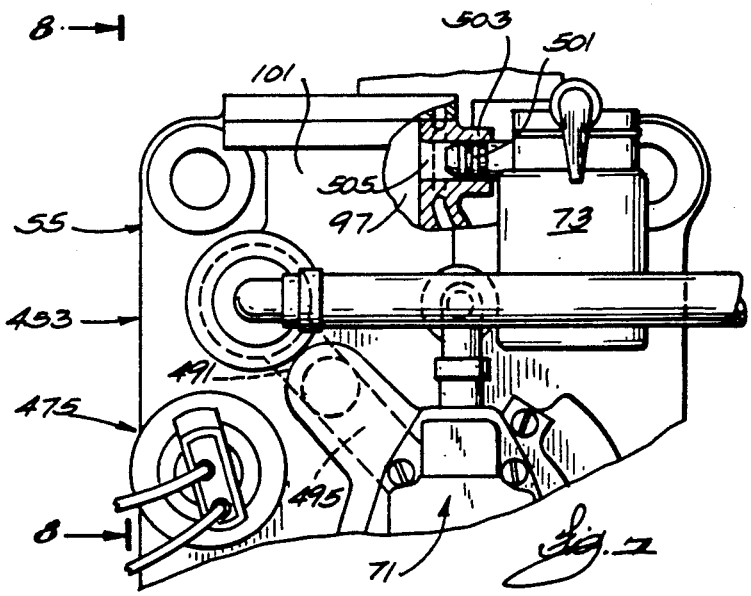
FIG. 7 is a fragmentary view, partially in section, of a second embodiment of fuel supply system component assembly embodying various of the features of the invention.
Figure 8:
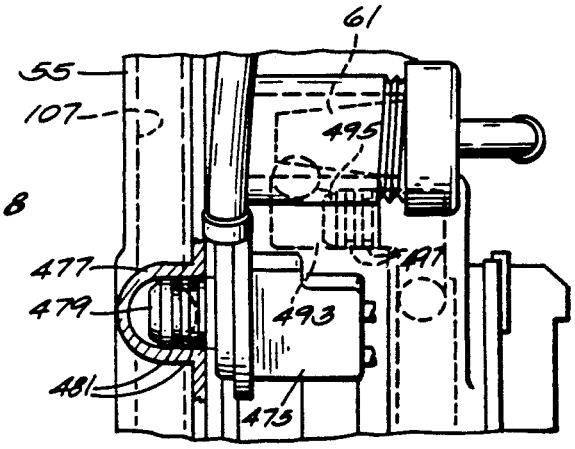
FIG. 8 is a fragmentary view taken along 8—8 of FIG. 7.

Shown fragmentarily in FIGS. 7 and 8 is another embodiment of a fuel supply system component assembly 453 which is identical to the assembly shown in FIGS. 2 through 4 except that the mounting bracket 55 is constructed in any suitable manner so as to provide the fuel supply conduit 107 with (see FIG. 8) a socket or well 477. In addition, the assembly 453 shown in FIGS. 7 and 8 includes a vacuum switch 475 which is identical to the vacuum switch 75 already described except that the vacuum switch 475 includes a pressure inlet 479 which is sealingly received in the socket 477 and sealed with respect thereto by a pair of suitable 0-rings 481 so as to prevent leakage through this connection. This construction eliminates the exterior hose or tube 371.

The fuel supply system component assembly 453 shown in FIGS. 7 and 8 also differs from the assembly 53 shown in FIGS. 2 through 4 in that the fuel supply conduit 107 is closed at its lower or discharge end and, instead, includes (see FIG. 7) a branch 491 terminating (see FIG. 8) in a socket or well 493, and in that the combined fuel and oil pump 71 includes a fuel inlet 495 which extends into and is sealingly received by the socket or well 493 of the fuel supply branch 491 incident to connection of the combined fuel and oil pump 71 to the mounting bracket 55. As before, a pair of suitable 0-rings 497 can be employed to prevent loss of fuel through this connection. This construction serves to eliminate the exterior fuel supply hose or conduit 375 previously described.

Thus, the fuel supply system component assembly 453 shown in FIGS. 7 and 8 is arranged so that all of the connections between the various components on the mounting bracket 55 are effected incident to assembly of the components on the bracket.

The fuel supply system component assembly 453 also differs from the assembly 53 in that the primer fuel control valve 73 is supplied unmixed fuel as distinguished from a fuel/oil mixture. In this regard, in the construction shown in FIG. 7, a primer fuel inlet 501 is received in a well or socket 503 formed in an interior conduit 505 communicating with the reservoir 97 and subject to an increase in pressure by means (not shown) either in the form of a conventional pressure bulb or an electrically operated primer pump.

Various of the features of the invention are set forth in the following claims.

We claim:

1. An engine comprising a crankcase cover, a bracket, a fuel supply component mounted on said bracket and comprising one of a fuel pump, an oil pump, a combined fuel and oil pump, a fuel vapor separator, a fuel vapor pump, a fuel filter, a primer fuel control valve, and a vacuum switch, and means mounting said bracket on said cover.

2. An engine in accordance with claim 1 wherein said means mounting said bracket on said cover includes means for vibrationally isolating said bracket and said cover from each other.

3. An engine comprising an engine block, a crankcase cover mounted on said engine block and including opposite first and second sides, a first carburetor mounted on said block at said first side of said crankcase cover, a second carburetor mounted on said block at said second side of said crankcase cover, a bracket supported by said crankcase cover intermediate said first and second carburetors, and a fuel supply component mounted on said bracket and comprising one of a fuel pump, an oil pump, a combined fuel and oil pump, a fuel vapor separator, a fuel vapor pump, a fuel filter, a primer fuel control valve, and a vacuum switch.

4. An engine comprising a crankcase cover, a bracket having therein a fuel supply conduit including a socket, means mounting said bracket on said cover, a fuel supply component comprising one of a fuel pump, a combined fuel and oil pump, an oil pump, a primer fuel control valve, and a vacuum switch, said fuel supply component including a conduit having an end, and means mounting said fuel supply component on said bracket with said conduit end sealingly received in said socket.

5. A fuel supply system component assembly comprising a bracket adapted to be mounted on an engine member and having therein a fuel conduit including a socket, and a fuel supply component comprising one of a fuel pump, a combined fuel and oil pump, a primer fuel control valve, and a vacuum switch, said fuel component including a conduit having an end, and means mounting said fuel supply component on said bracket with said conduit end sealingly received in said socket.

6. A fuel supply system component assembly comprising a mounting bracket including an interior fuel supply conduit comprising first and second sockets and a fuel reservoir adapted to be connected to a source of fuel and having an open portion, an interior fuel/oil mixture conduit adapted to be connected to a point of use and including an inlet socket, and a primer fuel socket in one of said fuel supply conduit and said fuel/oil mixture conduit, a combined fuel and oil pump including a fuel/oil mixture discharge outlet, a fuel inlet, an oil inlet adapted to be connected to a source of oil, and a pressure inlet adapted to be connected to a source of pulsating pressure, means mounting said combined fuel and oil pump on said bracket with said fuel inlet sealingly received in said first socket in said fuel supply conduit, and with said fuel/oil mixture discharge outlet sealingly received in said inlet socket of said fuel/oil mixture conduit, a primer fuel control valve including a primer fuel conduit having a primer fuel inlet, and a primer fuel outlet adapted to be connected to an exterior conduit, means mounting said primer fuel control valve on said bracket with said primer fuel inlet sealingly received in said primer fuel socket, a fuel vapor pump assembly including a reservoir cover member and a fuel vapor pump including a fuel vapor inlet, a fuel vapor outlet adapted to be connected with an exterior conduit, and a pressure inlet adapted to be connected to a source of pulsating pressure, means mounting said fuel vapor pump assembly on said bracket with said cover member closing said fuel reservoir open portion, and with said fuel vapor inlet in communication with said reservoir, a vacuum switch including a pressure fluid inlet, and means mounting said vacuum switch on said bracket with said pressure fluid inlet sealingly received in said second socket in said fuel supply conduit.

7. A fuel supply system component assembly comprising a mounting bracket including an interior fuel supply conduit including a fuel reservoir portion having an open portion, an outlet socket, and a fuel inlet nipple adapted to be connected to a source of fuel, an interior fuel/oil mixture conduit adapted to be connected to a point of use and including an inlet socket, and a primer fuel socket in one of said fuel supply conduit and said fuel/oil mixture conduit, a combined fuel and oil pump assembly including a fuel/oil mixture discharge outlet, a fuel inlet, an oil inlet adapted to be connected to a source of oil, and a pressure inlet adapted to be connected to a source of pulsating pressure, means mounting said combined pump assembly on said bracket with said fuel inlet sealingly received in said outlet socket, and with said fuel/oil mixture discharge outlet sealingly received in said inlet socket of said fuel/oil mixture conduit, a primer fuel control valve including a primer fuel conduit having a primer fuel inlet, and a primer fuel outlet adapted to be connected to an exterior conduit, means mounting said primer fuel control valve on said bracket with said primer fuel inlet sealingly received in said primer fuel socket, a fuel vapor pump assembly including a reservoir cover member and a fuel vapor pump including a fuel vapor inlet, a fuel vapor outlet adapted to communicate with an exterior conduit, and a pressure inlet adapted to be connected to a source of pulsating pressure, means mounting said fuel vapor pump assembly on said bracket with said cover member closing said open portion of said reservoir, and with said fuel vapor inlet communicating with said reservoir, a vacuum switch including a Pressure fluid inlet communicating with said fuel supply conduit, and means mounting said vacuum switch on said bracket.

8. A fuel supply system component assembly comprising a mounting bracket including an interior fuel supply conduit, an interior fuel/oil mixture conduit including an inlet socket, a discharge port, and a primer fuel socket, and a fuel reservoir communicating with said fuel conduit and having a first open portion and a second open portion, a fuel filter removably located in said first open portion, a cover removably connected to said first open portion and including a fuel inlet nipple adapted to be connected to a source of fuel, a combined fuel and oil pump including a fuel/oil mixture discharge outlet, a fuel inlet, an oil inlet adapted to be connected to a source of oil, and a pressure inlet adapted to be connected to a source of pulsating pressure, means removably mounting said combined fuel and oil pump on said bracket with said fuel/oil mixture discharge outlet received in said inlet socket of said fuel/oil mixture conduit, an exterior conduit connecting said fuel supply conduit and said fuel inlet of said combined fuel and oil pump, a primer fuel control valve including a fuel/oil mixture inlet, first and second fuel/oil mixture outlets adapted to be connected to respective exterior conduits, a primer fuel/oil mixture conduit extending between said fuel/oil mixture inlet and said fuel/oil mixture outlets and including therein a solenoid operated valve member movable between a closed position preventing flow of primer fuel/oil mixture and an open position permitting flow of primer fuel/oil mixture, means removably mounting said primer fuel control valve on said bracket with said fuel/oil mixture inlet sealingly received in said primer fuel socket, a reservoir cover member including a fluid pressure sensing outlet, a fuel vapor passage, and a fuel/oil mixture conduit including an inlet port and first and second discharge outlets adapted to be connected to respective exterior conduits, means removably mounting said cover member on said bracket with said cover member closing said second open portion of said reservoir, with said fuel vapor passage communicating with said reservoir, with said fluid pressure sensing outlet communicating with said reservoir, and with said fuel/oil mixture inlet port in communication with said fuel/oil mixture discharge port, a fuel vapor pump including a fuel vapor inlet, a fuel vapor outlet adapted to communicate with an exterior conduit, and a pressure inlet adapted to be connected to a source of pulsating pressure, means removably mounting said fuel vapor pump on said cover member with said fuel vapor passage in communication with said fuel vapor inlet, a vacuum switch including a fluid pressure inlet, an exterior conduit connecting said fluid pressure inlet and said fluid pressure sensing outlet, and means removably mounting said vacuum switch on said bracket.

* * * * *